US005366222A

United States Patent [19]

Lee

[11] Patent Number: 5,366,222

[45] Date of Patent: Nov. 22, 1994

[54] GOLF CLUB HEAD HAVING A WEIGHT DISTRIBUTING SYSTEM

[76] Inventor: Steven P. Lee, 25 - 5th St., North Arlington, N.J. 07031

[21] Appl. No.: 155,832

[22] Filed: Nov. 23, 1993

[51] Int. Cl.[5] ..... A63B 53/04

[52] U.S. Cl. ..... 273/170; 273/169

[58] Field of Search ..... 273/170, 167 R, 169, 273/167 H

[56] References Cited

U.S. PATENT DOCUMENTS

| | | | |
|---|---|---|---|
| 2,592,013 | 4/1952 | Curley | 273/170 |
| 3,951,413 | 4/1976 | Bilyeu . | |
| 4,135,720 | 1/1979 | Lancelloti | 273/170 X |
| 4,932,661 | 6/1990 | Choi . | |
| 5,054,784 | 10/1991 | Collins | 273/167 H X |
| 5,141,230 | 8/1992 | Antonious . | |
| 5,193,805 | 3/1993 | Solheim . | |
| 5,195,747 | 3/1993 | Choy . | |

FOREIGN PATENT DOCUMENTS

| | | | |
|---|---|---|---|
| 3251268 | 11/1991 | Japan | 273/170 |
| 4108465 | 4/1992 | Japan | 273/170 |

*Primary Examiner*—Vincent Millin
*Assistant Examiner*—Raleigh W. Chiu
*Attorney, Agent, or Firm*—Birch, Stewart, Kolasch & Birch

[57] ABSTRACT

A wood golf club head includes a golf club head cavity, a steel ball within the golf club head cavity, and a permanent magnet plate attached to the back side of the club head cavity whereby upon hitting the golf ball, the steel ball moves and hits an inner sweet point corresponding to a sweet point of the front surface face of golf club head, so that the struck ball will fly in a straight direction and in a longer distance compared with an expected golf ball distance.

9 Claims, 1 Drawing Sheet

FIG. 1
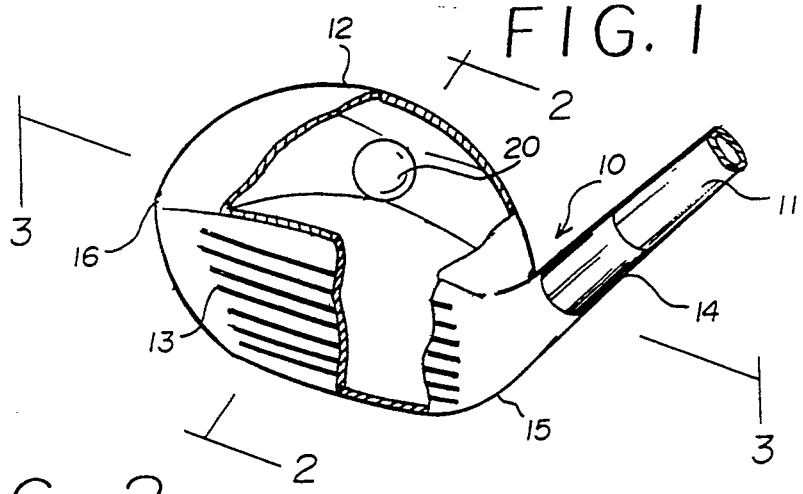
FIG. 2
FIG. 3
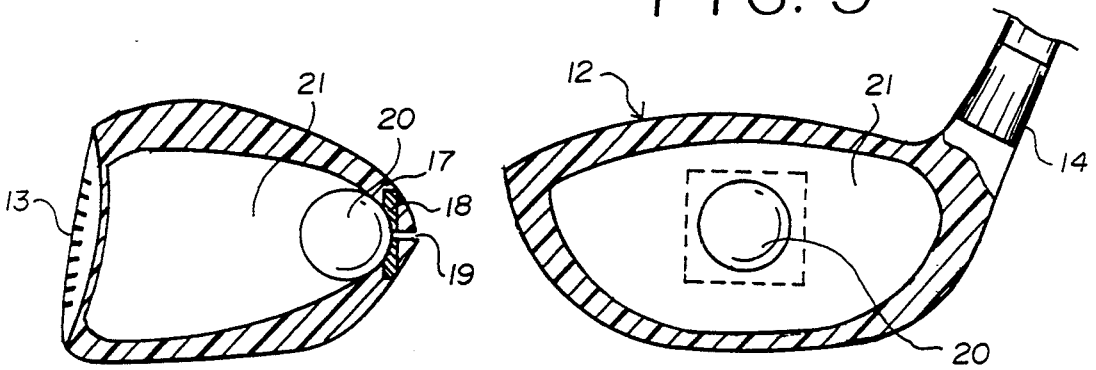
FIG. 4
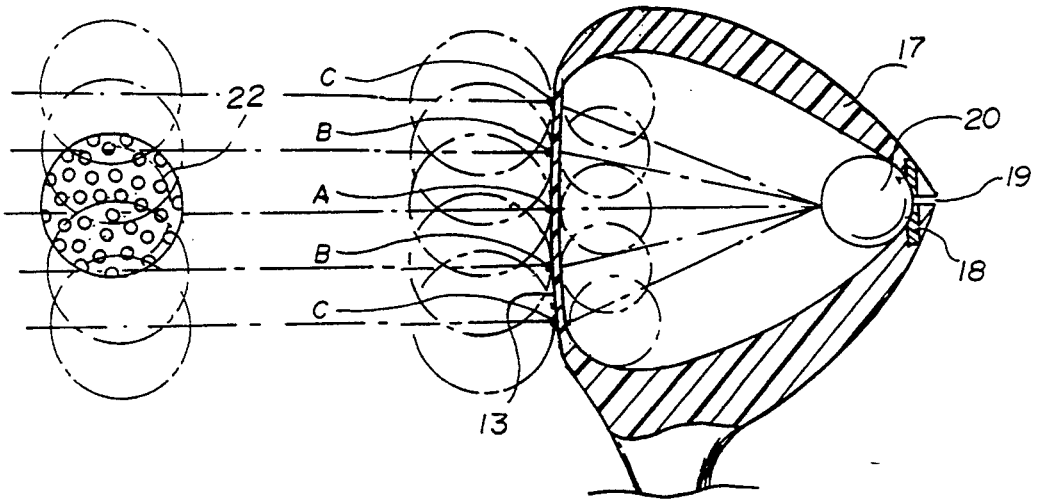

GOLF CLUB HEAD HAVING A WEIGHT DISTRIBUTING SYSTEM

BACKGROUND OF THE INVENTION

1. Field of the Invention

The present invention relates to a golf club head having a weight distributing system and more particularly, to a wood type golf club head having an integrally formed steel ball within the club head cavity so as to have improved performance characteristics resulting from strategic changes in weight dispensation of the steel ball.

2. Description of Related Art

Several types of golf club heads having a movable weight therein such as golf club drivers are known in the art.

Golf is a game which requires exacting techniques to achieve a proper swing. One aspect of a proper swing relates to the swing plane which is the plane in which club should substantially move during a swing. The basic determinative factors with regard to the position of a golfer's swing plane is his or her physical stature and his or her address posture. The more a golfer bends over the ball from the waist at address, and the closer he sets his hands to his body, the more upright becomes the plane in which he naturally tends to swing. Conversely, short golfers tend to swing in a flatter plane, i.e. a less upright plane, than tall golfers because their lack of height in relation to the standard length of club shafts forces them to stand farther from the ball. The swing plane also shifts between different clubs because of differences in their relative lengths.

Another important aspect of a proper golf swing is the desirability that the head of the club strike the ball at that point of the golf swing where the club head velocity is the greatest and that such speed be maintained into the follow-through. Maximum force of impact between the club face and the ball is obtained without the club head torquing when the ball is hit in the "sweet spot" of the club head face. The sweet spot is typically located at the center of the club face and has been thought of as the location on the club face directly forward of the center of gravity of the club head. For example, a golfer may locate the sweet spot of a putter by holding it lightly between the thumb and forefinger at the top end of the grip and then gently tap the face of the putter head with an object such as a ball at different locations on the club face until the club head recoils straight back and forth like a pendulum without twisting or torquing off-line.

Accordingly, this approach does locate the sweet spot of the club while essentially at rest. However, as the club is fully swung, often in various swing planes due to swing inconsistencies of golfers of average ability, the sweet spot actually shifts due to redistribution of the mass of the club head with respect to the swing plane where it extends through the club head, and to differences in different speeds of different portions of the club head. Because the sweet spot of a club in motion is determined relative to mass and velocity of the club, it may be referred to as the center of inertia of the golf club. Such shifting of the center of inertia hampers a golfer's ability to make ball contact at the sweet spot. The further a ball is hit from the center of inertia the more it will tend to be misdirected or imparted with a side spin.

It thus is seen that a need remains for a golf club that can substantially maintain its center of inertia or sweet spot in the same location upon the club head regardless of the orientation of the plane in which the club is swung or its velocity. It is to the provision of such therefore that the present invention is primarily directed.

Also, a driver in general has a long shaft that requires a swing to take an arcuate path to meet a ball placed a distance in front of the golfer. Motion over this path introduces a torque during the swing which tends to twist the head position away from a square contact with the ball. Thus, a golfer must develop a swing that controls the club by tempo, speed and grip to address the ball squarely. Accordingly it requires a high degree of skill to address a ball properly with a wood or driver.

Metal wood golf club heads formed by a light weight durable metal shell having a hollow interior currently enjoy a high level of popularity compared with conventional wood type club head designs. Metal wood heads have been known for a number of years, as evidenced by U.S. Pat. No. 1,568,888 and Australian Pat. No. 211,781.

Furthermore, such golf club heads having a weight therewithin disclose U.S. Pat. Nos. 3,951,413, 5,141,230, 5,193,805, and 5,195,747. However, these patents do not disclose the use of a steel ball within a club head cavity for hitting the golf ball behind a front surface so as to improve performances such as a long distance hit, straight ahead accuracy of the golf ball, less effort of a golfer and the like.

SUMMARY OF THE INVENTION

Accordingly, it is an object of the present invention to provide a golf club head having a weight distributing system, which eliminates the above problems encountered with conventional golf club heads.

Another object of the present invention is to provide a wood type golf club head which includes a golf club head cavity, a steel ball disposed within the golf club head cavity, a permanent magnet plate attached to the interior of a back side of the golf club head, and an air aperture disposed behind the permanent magnet plate for having improved performance characteristics resulting from strategic changes in weight dispensation of the steel ball.

A further object of the present invention is to provide a wood type golf club including a steel ball within a golf club head cavity whereby upon hitting a golf ball, simultaneously the steel ball moves from a permanent magnet and hits an interior spot behind a hitting spot of a front surface face by the golf ball so that the impacted ball flies a long distance and the straight direction toward the golf green.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of the golf club head having a weight distributing system containing cut away portions in order to illustrate the construction of the golf club head of the present invention;

FIG. 2 is a right side elevational view of the golf club head having a weight distributing system of FIG. 1 shown partly in cross-section;

FIG. 3 is a front view of the golf club head having a weight distributing system of FIG. 1 shown partly in cross-section; and FIG. 4 is a pictorial view, showing a ball hitting the golf club head having a weight distributing system according to the present invention.

DETAILED DESCRIPTION OF PREFERRED EMBODIMENTS

Referring now in detail to the drawings for the purpose of illustrating preferred embodiments of the present invention, the golf club head having a weight distributing system as shown in FIGS. 1, 2, and 3, comprises a golf club 10, preferably a wood type golf club 10, embodying principles of the present invention having an elongated shaft 11 and a golf club head 12 mounted at one end of the elongated shaft 11, and a movable steel ball 20 disposed within a golf club head cavity 21. The golf club head cavity 21 occupies about 80% of an entire golf club head 12.

The golf club head 12 includes a front surface face 13 generally known as the ball striking face, a hasel 14, a heel 15, a toe 16, a back surface 17, and a permanent magnet plate 18 attached to the interior of the back side 17 and in the vicinity of an air aperture 19 thereof.

The steel ball 20 is provided with a size and weight similar to those of a conventional golf ball 22 (FIG. 4). However, the size and weight of the steel ball 20 can be adjusted depending on many factors such as a woman's golf club.

The golf club 10 having the golf club head 12 according to the present invention operates as follows. As shown in FIG. 4, when a golfer swings forward (not shown) and hits a golf ball 22, the golf ball 22 strikes a sweet point, for example A, B, C, of the front surface face 13 (see dotted line golf ball). At this time, simultaneously, the steel ball 20 moves from the permanent magnet plate 18 to an inner sweet point of the interior of front surface face 13 within the golf club head cavity 21.

Accordingly, if the golf player hits the golf ball 22 at the "C" sweet point, at this time, simultaneously the steel ball 20 hits behind the "C" sweet point. Therefore, the golf ball 22 will fly in a straight direction so that the golf ball 22 may be on the fairway and also, a golf ball distance is longer than the golf ball 22 can fly under original circumstances. The air aperture 19 functions as a kind of air passage to the atmosphere in order to freely move the steel ball 20 within the golf head cavity 21 during operation. Thus, the golf club 10 according to the present invention can enlarge the hitting area of the front surface face 13 so as to hit the golf ball 22, directs the golf ball 22 in a straight direction, and extends the golf ball distance compared with that in the original situation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf club head having a weight distributing system, said golf club defining a front surface face and a back surface, said golf club head comprising:

a movable ball;

a golf club head cavity disposed within the golf club head, the movable ball being disposed within said golf club head cavity and the cavity having a size such that the movable ball is movable therein in a direction nonperpendicularly to the front surface face of the golf club;

a permanent magnet plate attached to the back side of said golf club head cavity for securing the movable ball during non-operation; and an air aperture disposed at said back surface thereof and in communication with said golf club cavity for forming an air passage, whereby upon hitting a golf ball, the movable ball always moves and hits an interior sweet point of a sweet point corresponding to the exterior of the front surface face from the permanent magnet plate, so that the struck golf ball will fly in a straight direction and a longer distance compared with an expected golf ball distance, the interior sweet point being changeable between swings of the golf club dependent upon where the golf ball strikes the front surface face.

2. The golf club head of claim 1, wherein said golf club head is a wood club including a driver.

3. The golf club head of claim 1, wherein the movable ball is a steel ball.

4. The golf club head of claim 1, wherein the golf club head cavity occupies about 80% of the entire golf club head.

5. The golf club head of claim 1, wherein the sweet point on the exterior of the front surface face is a point at which the front surface face strikes the golf ball and is movable with the interior sweet point between swings of the club and is dependent upon where the front surface face strikes the golf ball.

6. The golf club head of claim 5, wherein the movable ball automatically adjusts for changes in the sweet point such that the movable ball always moves and hits the interior sweet point.

7. The golf club head of claim 1, wherein the movable ball automatically adjusts for changes in the sweet point such that the movable ball always moves and hits the interior sweet point.

8. The golf club head of claim 1, wherein the golf club cavity increases in size from the back surface toward the front surface face of the golf club.

9. The golf club head of claim 1, wherein the air aperture extends through the permanent magnet.

* * * * *